US008318613B2

(12) United States Patent
Stockum et al.

(10) Patent No.: US 8,318,613 B2
(45) Date of Patent: Nov. 27, 2012

(54) COMPOSITION FOR MANUFACTURING $SiO_2$ RESIST LAYERS AND METHOD OF ITS USE

(75) Inventors: Werner Stockum, Reinheim (DE); Ingo Koehler, Reinheim (DE); Arjan Meijer, Darmstadt (DE); Paul Craig Brookes, Southampton (GB); Katie Patterson, Portsmouth (GB); Mark James, Romsey (GB)

(73) Assignee: Merck Patent GmbH, Darmstadt (DE)

( * ) Notice: Subject to any disclaimer, the term of this patent is extended or adjusted under 35 U.S.C. 154(b) by 0 days.

(21) Appl. No.: 12/934,365

(22) PCT Filed: Mar. 2, 2009

(86) PCT No.: PCT/EP2009/001465

§ 371 (c)(1),
(2), (4) Date: Sep. 24, 2010

(87) PCT Pub. No.: WO2009/118083

PCT Pub. Date: Oct. 1, 2009

(65) Prior Publication Data

US 2011/0021037 A1 Jan. 27, 2011

(30) Foreign Application Priority Data

Mar. 26, 2008 (EP) ..... 08005635
Sep. 2, 2008 (EP) ..... 08015460

(51) Int. Cl.
*H01L 21/316* (2006.01)
*C08G 77/60* (2006.01)

(52) U.S. Cl. ..... 438/780; 257/E21.271; 528/35

(58) Field of Classification Search ..... 252/182.14; 257/E21.271; 438/778, 780, 787, 790; 528/20, 528/29, 35

See application file for complete search history.

(56) References Cited

U.S. PATENT DOCUMENTS

2006/0160373 A1* 7/2006 Kowalski et al. ..... 438/778
2007/0004202 A1 1/2007 Fujii
2007/0299176 A1 12/2007 Markley et al.

FOREIGN PATENT DOCUMENTS

DE 10101926 A1 10/2001
WO 0183391 A1 11/2001

OTHER PUBLICATIONS

World Intellectual Property Organization. "International Search Report." PCT/EP2009/001465. Applicant: Merck Patent GMBH. Mailed Oct. 5, 2009.

Espacenet Database: "English Abstract-Aetzpasten fuer anorganische Oberflaechen." DE10101926A1, Applicant: Merck Patent GMBH. Date: Oct. 31, 2001.

Goetzberger, A. et al. "Sonnenenergie: Photovoltaik Physik und Technologie der Solarzelle." (B.G. Teubner Stuttgart) p. 115, p. 141., 1997.

* cited by examiner

*Primary Examiner* — Julio J Maldonado
*Assistant Examiner* — Daniel Shook
(74) *Attorney, Agent, or Firm* — Millen, White, Zelano, Branigan, P.C.

(57) ABSTRACT

The present invention relates to compositions, which are useful for the generation of patterned or structured $SiO_2$-layers or of $SiO_2$-lines during the manufacturing process of semiconductor devices, and which are suitable for the application in inkjet operations. The present invention also relates to a modified process of manufacturing semiconductor devices taking advantage of these new compositions.

35 Claims, 6 Drawing Sheets

(a) $T_{substrate} = 60°C$ (b) $T_{substrate} = 90°C$ (c) $T_{substrate} = 140°C$ 1. Inkjet application of structured SiO2 layer (printing and drying - only 2 process steps)

2. n++ POCl3 diffusion step

3. Complete removal of SiO2 layer 4. n+ POCl3 diffusion step

5. Deposition of antireflection layer (SiO2 or SiNx)

COMPOSITION FOR MANUFACTURING $SiO_2$ RESIST LAYERS AND METHOD OF ITS USE

The present invention relates to compositions, which are useful for the generation of patterned or structured $SiO_2$-layers or of $SiO_2$-lines during the manufacturing process of semiconductor devices, and which are suitable for the application in inkjet operations. The present invention also relates to a modified process of manufacturing semiconductor devices taking advantage of these new compositions.

PRIOR ART

Semiconductor devices usually have a pattern of highly doped regions, which are located in some distance apart from each other in a semiconductor substrate, and low doped regions, which are located between the highly doped. The doping pattern is achieved by applying a suitable doping composition at least applied on highly doped regions. Then the substrate is subjected to a diffusion step in which doping atoms diffuse from the applied doping composition into the substrate and contacts are prepared on the highly doped regions.

Different methods are known for the manufacturing of contacts in semiconductor devices and there are numerous processes for increasing the efficiency of produced devices. It has been found advantageous to dope the region beneath the contacts on the emitter's side to a greater extent than the $n^+$ region, i. e. to carry out a $n^{++}$ diffusion with phosphor. These structures are known as selective or two stage emitters [A Goetzberger, B. Voß , J. Knobloch, Sonnenenergie: Photovoltaik, p. 115, p. 141].

All these known processes for the production of solar cells with selective emitters are based at least on one structuring step. Commonly, these processes use photolithographic methods for the building of apertures, which enable to dope locally into $SiO_2$ layers—which again prevent the underlying silicon layer from doping in the gas phase (doping with POCl3 or PH3). The doping windows are etched into $SiO_2$ with using HF, $NH_4HF_2$.

Processes used for the locally opening of $SiO_2$-layers by application of etching pastes are disclosed in DE 10101926 or WO 01/83391.

So far an implementation of mass production of such high efficient solar cells with e.g. selective emitters generally failed due to a needed increase of process steps and of increasing manufacturing costs in comparison to common processes for the production of standard solar cells (without selective emitters).

OBJECT OF THE INVENTION

The object of the present invention is therefore to provide a corresponding simple and inexpensive process and a suitable composition which can be employed therein, enabling the disadvantage and problems outlined above to be avoided and by means of which patterned or structured $SiO_2$-layers or of $SiO_2$-lines during the manufacturing process of semiconductor devices may be generated and which allow the application of inkjet operations. A further object of the invention is to provide a new and highly efficient process for the production of solar cells with a reduced number of manufacturing steps which allow the implementation of the developed process into mass production.

DETAILED DESCRIPTION OF THE INVENTION

Figure 1:
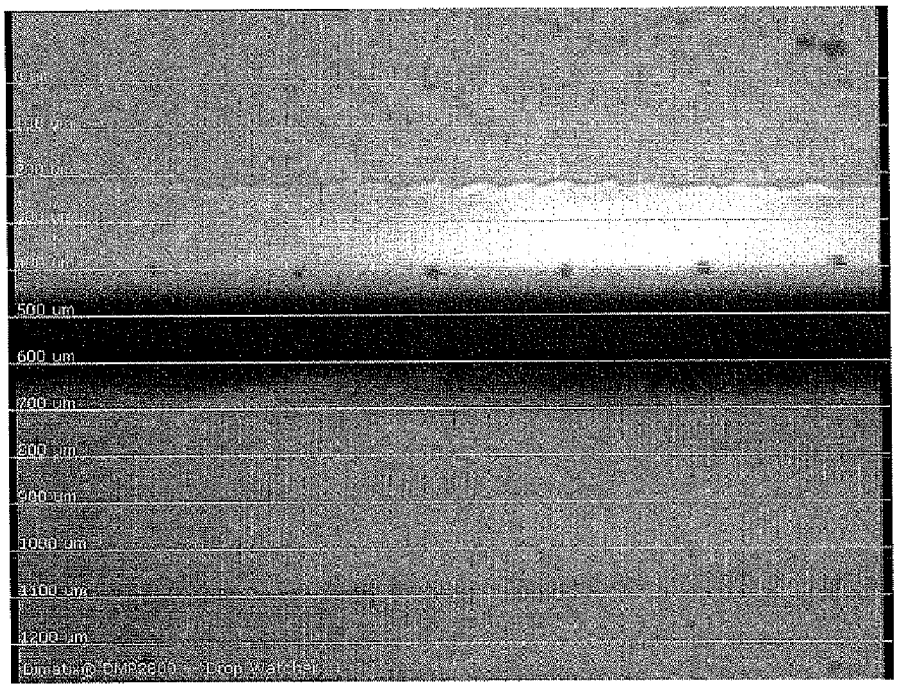
FIG. 1 shows an image of the high quality of the jetting obtained by a process according to Example 1.

In order to overcome the problem of numerous, costly and time consuming manufacturing steps a lot of experiments were made, by which it was found, that a dope mask, which is hereinafter referred as Solar Resist, is suitable to protect areas of silicon wafers from doping processes in PV production. The manufacturing of this dope mask mainly takes place by application of polymeric/oligomeric silicates or siloxane based $SiO_2$ precursors from solution. In a second step this precursor layer is treated at elevated temperatures (baking) in order to liberate an impermeable film consisting of $SiO_2$. This film is able to mask Si against dopants for example against p doping by $POCl_3$.

In many printing processes, like inkjet, soft lithography and variants of this printing process, micro-stamping, flexo and gravure printing inks of low to medium viscosity (1-150 cps) are used.

It was found, that inkjet printing of Solar resist is an advantageous manner to apply precursor materials for $SiO_2$-layers, because the application of the precursor compositions may be carried out without contacting surfaces with printing tools. Thus, it is particularly suitable for the treatment of fragile substrates. Advantageously the printing is digitalised and makes it is easy to modify the printed image and to provide one-offs etc.

Another advantage of inkjet printing is the fact, that it provides better resolutions than screen printing. Thereby the consumption of material is more efficient.

But in order proceed an inkjet printing process under optimized conditions, wherein the material is used efficiently, a number of limitations has to be considered.

At first there is a strong need for the use of fluids with correctly adapted properties. Typically, fluids used in ink jet printing processes show viscosities in the range of 2-15 cps (head dependant), Newtonian or close to Newtonian fluid properties and surface tensions in the range of 25-40 dynes/cm (head dependant).

The composition of the printed ink has to be considered in the choice a suitable inkjet head. The latter has to be made of a material, which is compatible with the properties of the printed inks in order to avoid corrosion, de-lamination, dissolving or weakening adhesives, coating of surfaces or destabilisation of the printed inks as well as of the ink jet head itself etc.

This means, that the material of which the printing head is made has to be stable, so that it does not change significantly its chemical structure and physical properties etc. during the printing process. But also tubes and equipments, which are in contact with the inks have to be stable to avoid contamination of the precursor ink.

But most important seem to be the properties of the ink composition and experiments have shown, that the comprising carrier fluid has to have an adapted volatility with the effect that it does not dry out in the inkjet head, especially around the nozzle, and still stays removable from the printed substrate.

Taking into account all these particular requirements it was found by various attempts, that a modified composition, which is made from a commonly used product for the building of barrier $SiO_2$ films in wafer production processes, but which is usually spin coated onto Si wafers, can be used for an ink jet printing process. This known composition, which comprises an oligomeric silicate of the general formula (I), may be produced in an acid catalysed (acetic acid) reaction of Wacker TES40 WN (a commercially available mixture of monomeric, various oligomeric and cyclic ethyl silicate with approximately 5 Si—O units) with ethanol in an ethyl acetate solution. It can be spin coated on Si wafers and then dried to remove the solvent. In a following step the prepared coating may be treated at elevated temperature in order to convert the silicate oligomer into a $SiO_2$ barrier film.

(I)

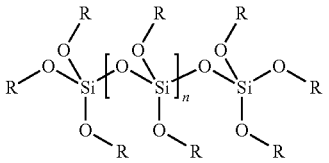

wherein independently from each other

R A, AOA, Ar, AAr, AArA, AOAr, AOArA, AArOA, wherein A is linear or branched $C_1$-$C_{18}$-alkyl, or substituted or unsubstituted cyclic $C_3$-$C_8$ alkyl; Ar is a substituted or unsubstituted aromatic group having 6-18 carbon atoms, and, $n$=1–100 and wherein R may build a further direct bond to Si or to neighbouring Groups R in order build cross-linked structures.

According to the present invention groups R of compounds according to the general formulae (I) may also be bound to neighbouring groups R or to neighbouring Si atoms or to Si atoms of a second molecule in order to build for some low levels cross-linked structures by both Si—O—Si links and Si—O—R—O—Si links.

In the general formulae (1), the term linear or branched $C_1$-$C_{18}$-alkyl is taken to mean linear or branched or cyclic carbon chains having from 1 to 18 carbon atoms. These are, for example, methyl, ethyl, i- and n-propyl groups and as further groups in each case the branched and unbranched isomers of butyl, pentyl, hexyl or heptyl. Preferably R stands for methyl, ethyl, i- and n-propyl, most preferably R stands for ethyl, as commonly used in semiconductor production.

As such this composition, which is used in common spin-coating steps of Si wafer production processes, is not suitable for ink jet printing, because always it leads to a blocking of the printing devices.

But now it has been found, that the reaction mixture comprising the $SiO_2$ film precursor compounds (e.g. compound of the general formula (I)) as described above, may be modified such that it is inkjet printable at normal temperatures and at common printing speed rates. The aim of this modification is a composition, which has a low viscosity and quickly solidifies, but not until it has been printed onto the surface of the substrate.

Although it is essential that these inkjet printable compositions show excellent drying properties, unexpectedly it was found, that the addition of solvents with higher boiling points into the precursor compositions instead of solvents as usually added lead to very much better properties during the printing process, while the behaviour of the printed lines and structures remain almost unchanged and may even show better properties. As a result such precursor compositions containing solvents with higher boiling points are very suitable for inkjet printing of lines and structures with high resolution.

The precursor compounds for the building of $SiO_2$-layers are suspended in a solvent mixture consisting of ethanol/ethyl acetate and acetic acid and must stay in solution before use. If a precipitation takes place, it is not any more possible to prepare homogeneous $SiO_2$-layers from these solutions. But also hydrolysis of precursor compounds has to be avoided. Therefore, it is not possible to remove the contained solvents and simply to recreate the solution by addition of solvents with higher boiling point.

Now it has been found that the precursor composition remains stable and an early precipitation as well as a hydrolysis during the printing process may be avoided, if a suitable solvent or solvent mixture with a higher boiling point is added to the known precursor solution, which is already described ahead. Then the contained low boiling solvents ethanol/ethyl acetate and acetic acid may be removed, if necessary at reduced pressure. The choice of a suitable solvent or solvent mixture, which may be added, depends on various requirements, especially the chemical properties of the precursor compounds. They have to be compatible with the solvent or solvent mixture, but the added solvent or solvent mixture has to be inert against the inkjet printing head.

Since the solvent or solvent mixture is added to the solution as recovered from reaction mixture the difference between the boiling point of ethanol/ethyl acetate and acetic acid and the added solvent or solvent mixture has to be sufficient for a separation of the low boiling solvents by distillation at least at reduced pressure.

After distillation of low boiling solvents the remaining composition comprising the solvent or solvent mixture with high boiling point has to leave the $SiO_2$-layer building properties of the precursor mixture unchanged, but also to solve the problem of blocking the inkjet printing head.

In particular it was found, that good results are achieved, if the new solvent or solvent mixture is or contains a primary or secondary alcohol with high boiling point.

In order to prepare the modified composition the substitution solvent or solvent mixture is added to the original reaction mixture containing ethanol/ethyl acetate and acetic acid. This mixture is submitted to distillation and the low boiling solvents are distilled off at reduced pressure, e.g. by using a rotary evaporator or a distillation apparatus, which works at reduced pressure. Direct evaporation of the above reaction mixture to dryness would result in hydrolysis of the contained precursor compounds and in powdered $SiO_2$, which cannot simply be retransformed. Furthermore it was found, that the absence of a primary or secondary alcohol results in chemical instability and hydrolysis to $SiO_2$. Accordingly, only high boiling solvents or solvent mixtures seem to be suitable as substitutes, which provide at least one OH-group. These solvents have to be added prior to distillation.

Alternatively the oligomeric silicate of the general formula (I), may be produced by reacting the TES40 WN directly in the high boiling ink jet solvent, or solvent mix, with the addition of acetic acid catalyst and ethanol, ethyl acetate or other components as required. After the reaction is complete, the volatile solvents can be removed by evaporation or distillation as previously described.

But also during the inkjet printing process and the following conversion of the precursor composition into the applied $SiO_2$-layer the modified composition has to meet certain requirements.

For example the added high boiling carrier solvent must dissolve the $SiO_2$ film precursor of the general formula (I) at the jetting temperature. Additionally, it has been found, that the bulk, this means about 90% by weight, of the carrier solvent must have a boiling point higher than 100° C. and less than 400° C.

In order to stabilize the precursor compound or compounds the carrier solvent must have at least one alcohol functionality. This may be present either as a homogeneous mixture of one or more alcohols and one or more alcohol free co-solvents (e.g. n-butanol and tetralin mixed) or as a single alcohol or as a homogeneous mixture of alcohols (e.g. diethylene glycol monoethyl ether). A good stabilization of the precursor compound or compounds is achieved, if the at least 5% by weight of the added high boiling solvents are alcohols. Preferably the added high boiling alcohol should come at 10% by weight of the added high boiling solvents.

The modified precursor composition may comprise small quantities (up to 10% by weight) of low boiling (i.e. <100° C.) components. These low boiling solvents may be present in the ink composition either as a result of a reaction of the precursor with other ink components, for example ethanol, or by planned addition to the ink formulation.

In order to achieve a plain and even coating the concentration of the $SiO_2$ film building precursor in the inkjet printing composition must be in the range of >0.1% and <95% by weight, based on the composition as a whole.

After modification of the precursor composition with a high boiling solvent or solvent mixture the viscosity of the composition should be >2 cps but <20 cps at the jetting temperature. If necessary the viscosity may be regulated by the addition of suitable additives.

Another important physical value, which influences the printing result, is the surface tension of the composition. It should be >20 dyne/cm but <60 dyne/cm.

Furthermore the composition should not contain any disturbing particles, which could block the printing head or decline the printing quality. Therefore, the ink may be filtered e.g. to 1 micron or less after addition of the high boiling solvent and eliminating the low boiling solvents like ethanol/ethyl acetate and acetic acid.

In order to be able to produce high-quality $SiO_2$-layers it is important that all compounds used to prepare the ink preferably should not contain any metal cations, like $Na^+$, $K^+$ or others, especially not more than in a concentration of 10 ppm.

The chemical structure of the $SiO_2$ film precursor as characterized by the general structure (I) may change in the prepared composition. For example, the R groups may be exchanged by reaction with the other alcohol units, which are present in solution. For example, if a precursor composition with a compound according to the general formula (I), wherein R=ethyl, is prepared and modified as described with n-butanol R may be exchanged by the higher boiling alcohol and a precursor compound with R=ethyl and R=butyl may be built. This also may result in an increase of molecular weight, e.g. in (I), if n increases. The molecular weight may also increase by reaction of precursor molecules and the value of n may exceed at least 5 and even 100.

In order to maximise the printing resolution and to improve other ink parameters, it is possible to add optionally additional compounds. This means, further additives may be added to the ink composition. Another option is to modify the substrate surface before printing.

In this context additives, like surfactants, or low surface tension co-solvents, like inc F solvents and silicates may be added to the ink. Thus, the surface tension of the ink may be reduced. But it is important to choose additives and solvents or co-solvent, which are free of metal cations and which don't influence the stability of the precursor compounds.

Useful solvents for the preparation of compositions according to the present invention are alcohols, which are branched or unbranched aliphatic alcohols or substituted or unsubstituted cyclic alcohols or may be substituted or unsubstituted aromatic alcohols. Suitable alcohols may be mono-, di-, tri-, or polyhydric alcohols [($RCH_2OH$), ($R_2CHOH$), ($R_3COH$)], which may be aliphatic, cyclic, heterocyclic, aromatic or unsaturated. Examples for suitable aliphatic alcohols are methyl alcohol, ethyl alcohol, n-propyl alcohol, lisopropyl alcohol, n-butyl alcohol, 2-ethyl-1 butanol, sec-butyl alcohol, tert-butyl alcohol, isobutyl alcohol, iso-amyl alcohol, n-amyl alcohol, t-amyl alcohol, n-hexyl alcohol, heptanol, octanaol, allyl alcohol, crotyl alcohol, ethylene glycol, propylene glycol, trimethylene glycol, glycerol, methyl isobutyl carbinol, 2-ethyl-1-hexanol, diacetone alcohol, nonyl alcohol, decyl alcohol, cetyl alcohol, cyclohexanol, furfuryl alcohol, tetrahydrofurfuryl alcohol, benzyl alcohol, phenyl ethyl alcohol. These alcohols may be added as such or in mixtures.

In order to increase the pH stability of the modified new ink, it is advantageous to add small quantities of acid scavengers, base scavenges and/or buffers provided that they do not contain any metal cations.

The substrate surface may be modified before printing by pre-defining structures by applying banking materials. For example it is possible to apply a hydrophobic polymer by inkjet printing or by using photo-lithography technique. In particular it is possible to apply hydrophobic or hydrophilic areas on the substrate surface by use of for example photolithography techniques.

Additionally the total surface energy my be changed (either hydrophobic or hydrophilic) by plasma, surfactants, surface active monolayer (SAM), or other surface treatments.

Another possibility to change the substrate properties during printing is to apply the ink onto heated or cooled substrate surfaces.

The wet inkjet film can be dried at elevated temperatures, especially at temperatures in the range of 80-400° C. prior to conversion to barrier film of $SiO_2$, which is proceeded at temperatures in the range of higher than 500° C. and less than 1000° C.

On the other hand the wet inkjet film can be dried at reduced pressures prior to conversion to barrier film.

A further option is to prepare a suitable ink in form of a 'hot melt' type, which is i.e. liquid at jetting temperature but solid at room temperature. Inks of this feature may be prepared by use of solvents, which are solid at room temperature but melt at temperatures, at which in general the printing process is carried out.

The $SiO_2$ film precursor includes silicates or siloxane structures of the general structure (I), wherein R=linear or branched $C_1$-$C_{18}$-alkyl. The term linear or branched $C_1$-$C_{18}$- alkyl is taken to mean linear or branched or cyclic carbon chains as described above having from 1 to 18 carbon atoms. These are, for example, methyl, ethyl, i- and n-propyl groups and as further groups in each case the branched and unbranched isomers of butyl, pentyl, hexyl or heptyl. Preferably R stands for methyl, ethyl, i- and n-propyl, most preferably R stands for ethyl, as commonly used in semiconductor production. But R may also stand for cyclic or aromatic groups as defined above. Especially in solutions comprising alcohols selected from the group methyl alcohol, ethyl alcohol, n-propyl alcohol, lisopropyl alcohol, n-butyl alcohol, 2-ethyl-1 butanol, sec-butyl alcohol, tert-butyl alcohol, isobutyl alcohol, iso-amyl alcohol, n-amyl alcohol, t-amyl alcohol, n-hexyl alcohol, heptanol, octanaol, allyl alcohol, crotyl alcohol, ethylene glycol, propylene glycol, trimethylene glycol, glycerol, methyl isobutyl carbinol, 2-ethyl-1-hexanol, diacetone alcohol, nonyl alcohol, decyl alcohol, cetyl alcohol, cyclohexanol, furfuryl alcohol, tetrahydrofurfuryl alcohol, benzyl alcohol and, phenyl ethyl alcohol and alcohols, which are named in the following, R may stand for cyclic or aromatic groups.

For printing any type of inkjet head can be used, which is constructed for the generation of small dots with diameters of less than 80 μm in flight. Especially, the head can be arranged as a continuous or drop on demand (DOD) inkjet head. For the desired application preferably thermal, piezo, electrostatic or MEMs inkjet heads are used. Especially preferred inkjet heads are of the DOD type, and most preferred of the piezo or electrostatic type. Specific examples of traded inkjet printing heads of this type are: FujiFilm Dimatix SX3 head, SE and SE3 heads, DMP 1 or 10 pl IJ heads, Konica Minolta DPN head, 256 or 512 heads, Xaar Onmidot, HSS, Trident 256 jet and the like. Most preferred are the high accuracy types designed for high precision micro deposition which may incorporate drive per nozzle technology like the FujiFilm Dimatix SX3 and SE3 head and Konica Minolta DPN head.

By use of the modified new ink and inkjet printing heads as mentioned above the size of printed features are in the range of from 1 micron and larger but preferably less than 80 μm. This applies to lines and gaps and dots and gaps. It is also possible to print large areas with the new modified inks and appropriately adjusted the printing pattern and or ink jet heads. By appropriate choice of the printing head and adequate temperature the modified inks according to the present invention may be printed with good printing results. Useful printing compositions comprise the $SiO_2$ film precursor compound or compound mixture in a concentration in the range of >0.1% to <90% by weight, based on the composition as a whole, more preferably >0.5% to <50%, and most preferably >1% to <20%.

Modified inks with suitable properties are obtained, if ink diluents or solvents are added, which have boiling points of about 100° C. or higher but less than 400° C. More preferably solvents with boiling points in the range of >100° C. to <300° C., are added. Due to required process and ink characteristics most preferably solvents with boiling points >150° C. and <250° C. are used.

One of the most important ink properties, which is responsible for a good printability, is the viscosity of the complete formulation. As such, inks according to the invention may have a viscosity up to 150 cps, but these inks are not suitable for inkjet printing. In order to receive good results in inkjet printing processes the viscosity has to be in the range between >2 cps and <20 cps at the jetting temperature. More preferably inks are used, which show viscosities in the range between >4 cps and <15 cps at the jetting temperature, but the best results are achieved, if the viscosity is in the range between >5 cps and <13 cps at the inkjet printing temperature.

Furthermore the printing result depends on the surface tension of the ink composition, which again depends on various factors, like temperature of the printed composition, nature and concentration of the contained solvent and solutes or suspended compounds. During the actual printing the surface tension should be in a range between >20 dyne/cm and <60 dyne/cm, more preferably between >25 dyne/cm and <50 dyne/cm, but most preferably in the range between >28 dyne/cm and <40 dyne/cm.

The printing temperature of the inks has to be chosen in dependence on the boiling temperature of the contained solvent or solvent mixture in order to achieve good printing results but also to avoid problems with the printing device, for example blocking of the printing head. If the inks are handled in an inkjet process, it is important at which temperature the ink leaves the printing head. This means, that the temperature at which the ink leaves the printing head is the printing temperature. In general the prepared ink composition may be printed at temperatures in the range of room temperature up to 300° C. Preferably the inks are printed at temperatures in the range between room temperature up to 150° C., most preferably in the range between room temperature to 70° C.

After printing the applied ink lines, structures or areas are dried at elevated temperatures in the range of 80-400° C., preferably in the range of 100-200° C. If applicable or necessary, the drying may be proceeded at reduced pressure. In any case the drying temperature and the conditions of drying are adjusted to the nature of the solvent or solvent mixture, which has to be evaporated, on condition that the applied film remains plain and even and without any deformity.

If the drying is completed the $SiO_2$ precursor compositions are converted to the desired barrier film consisting of $SiO_2$. This conversion is effected at a temperature higher than 500° C. but less than 1000° C., preferably at a temperature higher than 650° C. and less than 900° C.

The $SiO_2$ layers, which are built during heat treatment consist nearly entirely of inorganic $SiO_2$, but may comprise very few traces of remaining organic groups or carbon, which is built during heat treatment and is not removed by oxidation. The surfaces of the prepared $SiO_2$ layers may furthermore show hydroxyl groups, but only in amounts, which don't influence the barrier function of the $SiO_2$ layers.

In order to proceed the drying and conversion the printed semiconductors are introduced into an oven with adjustable temperature. In order to reach the desired drying or conversion temperature, the temperature is elevated by slow degrees in order to save the treated wafers but also in order to evaporate the solvents smoothly.

The added ink diluent or solvent has to be liquid when mixed with the $SiO_2$ film precursor and at jetting temperature. This diluent or solvent may also be a solid as pure compound or may build a solid mixture together with the $SiO_2$ film precursor at room temperature, if it builds fluid compositions at printing temperature and if it shows viscosities and surface tensions as mentioned above.

Preferably the ink diluent is organic and contains >10% of at least one alcoholic component. As describe above the contained alcohol is preferably a primary or secondary alcohol or polyol (diol, triol etc) and most preferably it is a primary alcohol or a mixture thereof. Suitable alcohols for the preparation of $SiO_2$ precursor compositions are:

| Alcohol name | Boiling Point (° C.) |
|---|---|
| tetraethylene glycol | 314 |
| glycerol | 290 |
| dipropylene glycol | |
| 4-methoxybenzyl alcohol | 259 |
| tripropylene glycol | 268 |
| dipropylene glycol butyl ether | 228 |
| 2-phenoxyethanol | 237 |
| diethanolamine | 217 |
| triethylene glycol | 285 |
| ethylene glycol | 197 |
| 2-undecanol | |
| ethylene glycol 2-ethylhexyl ether | 224-275 |
| diethylene glycol propyl ether | 202-216 |
| ethylene glycol hexyl ether | 200-215 |
| diethylene glycol | 245 |
| 1-decanol | 231 |
| a-terpineol | 218 |
| lactic acid | |
| hexylene glycol | 197 |
| propylene glycol | 187 |
| 1-nonanol | 215 |
| dipropylene glycol methyl ether | 189 |
| diethylene glycol butyl ether | 231 |
| 1,3-butanediol | 204 |
| benzyl alcohol | 206 |
| 1-octanol | 196 |
| 2-methyl-2-heptanol | |
| 2-octanol | 178 |
| 2,2-dimethyl-1-pentanol | |
| 1-heptanol | 176 |
| ethylene glycol butyl ether | |
| 4-heptanol | |
| 3-heptanol | |
| diethylene glycol ethyl ether | 202 |
| tetrahydrofurfuryl alcohol | 178 |
| propylene glycol butyl ether | 170 |
| furfuryl alcohol | 170 |
| diacetone alcohol | 166 |
| 2-heptanol | 161 |
| ethanolamine | 170 |
| 5-methyl-2-hexanol | 149 |
| diethylene glycol methyl ether | 194 |
| ethylene glycol butyl ether | 169-173 |
| 1-hexanol | 157 |
| cyclohexanol | 161 |
| 3-methylcyclohexanol | 163 |
| 2,2-dimethyl-1-butanol | |
| 4-methyl-1-pentanol | 163 |
| ethylene glycol propyl ether | 149-154 |
| ethyl lactate | 154 |
| 2-hexanol | 136 |
| 2-methyl-1-pentanol | 148 |
| 2-ethyl-1-butanol | 146 |
| 3-hexanol | 135 |
| 3-methyl-2-pentanol | 134 |
| 1-pentanol | 137 |
| cyclopentanol | 140 |
| 4-methyl-2-pentanol | 132 |
| 2-methyl-3-pentanol | 128 |
| 3-methyl-1-butanol | 130 |
| ethylene glycol ethyl ether | 135 |
| 3,3-dimethyl-1-butanol | 143 |
| 2-methyl-1-butanol | 130 |
| 2-pentanol | 119 |
| ethylene glycol methyl ether | 125 |
| 3-pentanol | 115 |
| propylene glycol methyl ether | 118 |
| 1-butanol | 118 |
| 2-methyl-1-propanol | 108 |

The alcohols of this list are examples, which may be used for the preparation of the modified ink compositions according to the present invention, but further alcohols, which are not mentioned here, may be useful for this purpose, if they hit the requirements described above.

As already mentioned the alcoholic solvent or diluent may be mixed with at least one non-alcoholic solvent or co-solvent. Suitable co-solvents may be aromatic or heteroaromatic hydrocarbons, like toluene, xylene (all isomers), tetralin, indan, or other mono, di, tri, tetra, penta and hexa alkyl benzenes, naphthalene, alkyl naphthalene, alkylthiazoles, alkylthiophenes etc.

Also aliphatic hydrocarbons, like linear or branched alkanes like n-octane or ohters, cycloalkanes, like methylcyclohexane, decalin or the like, are suitable co-solvents, which can be used in inks according to the invention.

Suitable co-solvents are also aromatic and aliphatic fluoro solvents, like FC43, FC70, methyl nonafluorobutyl ether, 3-ethoxy-1,1,1,2,3,4,4,5,5,6,6,6-dodecafluoro-2-trifluoromethyl-hexane, perfluorodecane or the like, but also ethers, like ethylene glycol diethyl ether, esters, like amyl acetate , or lactones, like gamma-butyrolactone and the like, ketones, amides, like NMP or DMF and the like, sulphoxides like DMSO, sulphones like sulfolane and other polar and non-polar organic solvents.

Since the printed lines and structures should be prepared with a very high resolution and uniformity, inkjet printing heads with very small nozzles are used. This is why these heads are sensitive against blocking. To avoid this, the used ink should preferably be free of particles or only comprise very small particles. Therefore the inks are preferably filtered to less than 1 micron and more preferably to less than 0.5 micron.

Plain and even $SiO_2$ films may be prepared by use of the modified inks in a process comprising the steps of inkjet printing, drying and curing at high temperature. As a rule the resulting $SiO_2$ films have a uniform thickness in the range of >1 nm to <10 microns, more preferably of >10 nm to <1 micron and most preferably of >50 nm to <250 nm.

The use of the modified compositions is not restricted to inkjet printing processes. The $SiO_2$ precursor compositions showing low to medium viscosities in the range of 1-150 cps, especially those with higher viscosities, may also be applied on surfaces by micro-stamping/soft lithography, flexo and gravure process steps or variants of these printing processes.

In order to achieve in each application optimized results the $SiO_2$ precursor compositions have to be modulated but also the conditions during application influence the deposition results. For example, if the surfaces, which are to be treated, are heated to elevated temperatures, improved resolution results are achieved by inkjet printing. In general, improved deposition results are achieved, if the surface temperatures are in the range of between 80 to 120° C. Therefore, the compositions are applied preferably at temperatures in the range of between 85 to 110° C., although the optimal temperature is different for each composition depending on the comprising solvents and on the nature of the surface, upon which the composition is to be applied.

Figure 2:
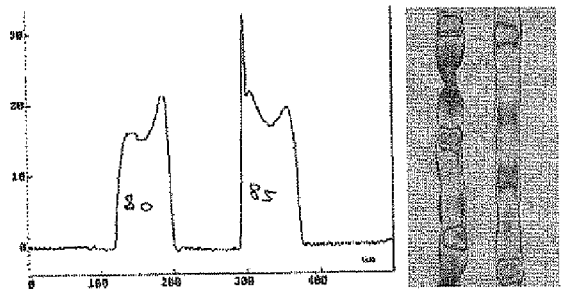
FIG. 2 shows height profiles measured with the pin profiler, and microscope images of isishape SolarResist™ lines printed on polished wafers for different wafer temperatures.
Figure 2:
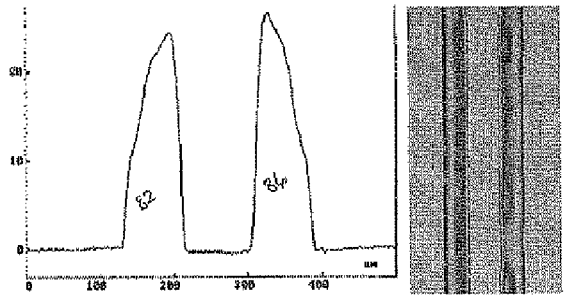
Figure 2:
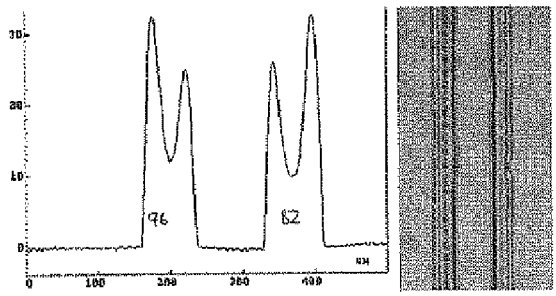

For example FIG. 2 shows height profiles and optical microscope images of lines printed with the Dimatix 2800 DMP system on polished wafers, at different temperatures $T_{substrate}$=(60, 90, 140)° C. Printing a representative composition according to the invention on wafers at less than 80° C. results in de-wetting of the ink prior carrier solvent evaporation and unacceptable image quality while printing at above 120° C. results in excessive 'coffee staining', where the edge is much thicker than in the middle [R. D. Deegan, O. Bakajin, T. F. Dupont, G. Huber, S. R. Nagel, and T. A. Witten, Nature 389 (1997) 827]. The optimum wafer temperature is 90° C., allowing for a film thickness around 220 nm.

FIG. 2 shows height profiles measured with the pin profiler, and microscope images of isishape SolarResist™ lines printed on polished wafers for different wafer temperatures. The best uniformity is obtained with $T_{substrate}$=90° C.

Advantageously the compositions according to the invention can be printed with high lateral resolution.

Resolution is controlled by the mechanical accuracy of the printer, drop size, ink spread prior to drying and the substrate surface. In order to further optimize the compositions for a high image quality with high lateral resolution, they were transferred by use of different ink jet printing systems. Exemplarily results are described, which are achieved with a Litrex system with SX3 printhead. A 12 pl drop typically ejected from the SX3 head has a diameter in flight of 29 microns.

An optimised line width of 90 μm can be obtained on polished and shiny etched wafers when multiple drops are used to form lines with the desired dry film thickness of >150 nm. Gaps between lines can be made smaller and are limited by surface roughness. The roughness of damage-etched and textured wafers result in some line spreading, however their roughness prohibits quantification by a pin profiler . Holes in printed big blocks of the composition can be obtained with feature sized down to 65 micron.

Figure 3:
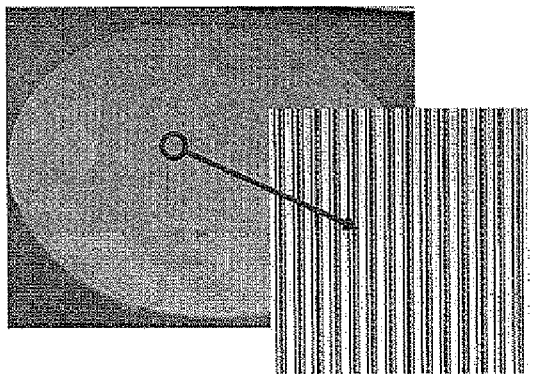
FIG. 3 shows a full polished silicon wafer with 90 μm lines and 50 μm gaps pattern printed on the Litrex system.

FIG. 3 shows a full polished silicon wafer with 90 μm lines and 50 μm gaps pattern printed on t he Litrex system.

In order to prove the functionality of such films as diffusion barriers prepared from the compositions according to the invention, two types of samples from 200 Ω cm p-type Si wafers are prepared: On the first type, narrow lines with a width of 100 μm with 100 μm-wide gaps are deposited by inkjet printing, similar to the ones shown in FIG. 3. These samples are used for laterally resolved SEM measurements. On the second type of samples, an area of 3.0 cm by 1.5 cm is completely covered with the ink composition. These samples are used for measurements of the depth-resolved dopant profiles by the ECV method. The applied diffusion process results in an emitter with a sheet resistance of 40 Ω/square on non-protected wafers.

Figure 4:
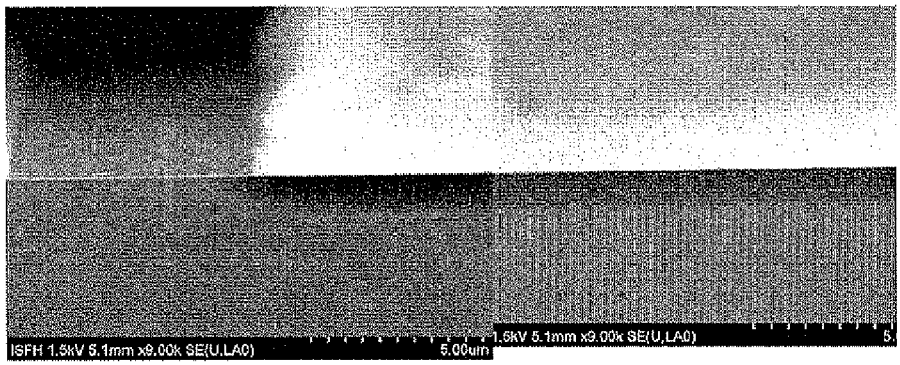
FIG. 4 shows a side-view SEM image of the cross-section of a partially ink composition covered p-type Si wafer after phosphorus diffusion and removal of the barrier layer.

FIG. 4 shows an SEM image of the cross-section of a sample of the first type. The left part of the sample was covered by a barrier line resulting from the applied ink composition, during phosphorus diffusion, while the right part represents a gap between two lines. The dark contrast at the cleaved edge of the non-protected right-hand part indicates n-type doping due to the diffusion of phosphorus atoms. The left-hand part was protected by a 190 nm thick barrier layer resulting from the applied composition. The bright contrast there indicates that no phosphorus has penetrated the wafer.

Thus, FIG. 4 shows a side-view SEM image of the cross-section of a partially ink composition covered p-type Si wafer after phosphorus diffusion and removal of the barrier layer. The dark contrast at the cleaved edge of the non-protected right-hand part indicates n-type doping due to the diffusion of phosphorus atoms. The left-hand part was protected by a 190 nm thick ink composition layer. The bright contrast there indicates that no phosphorus has penetrated the wafer.

Figure 5:
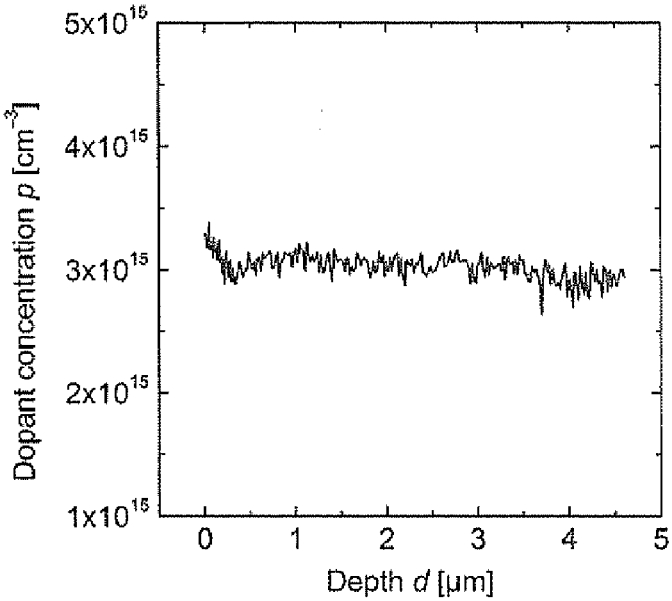
FIG. 5 shows a depth-resolved dopant profile obtained from ECV measurement within an exemplary ink composition protected area of a 200 Ω cm p-type Si wafer, after phosphorus-diffusion.

Again FIG. 5 shows the depth-resolved dopant profile obtained from ECV measurement within an exemplary ink composition protected area of a 200 Ω cm p-type Si wafer, after phosphorus-diffusion. Only the background doping of the substrate can be detected. These results show that locally applied, 190 nm thick films resulting from ink compositions according to the present invention provide protection of silicon wafers against industrially relevant phosphorus diffusion processes.

FIG. 5: shows a depth-resolved dopant profile obtained from ECV measurement within an exemplary ink composition protected area of a 200 Ω cm p-type Si wafer, after phosphorus-diffusion. Only the background doping of the substrate can be detected. The applied diffusion process results in an emitter with a sheet resistance of 40 Ω/square on non-protected wafers.

Besides its barrier function and ability to be printed with high resolution, the applicability of the compositions to solar cell manufacturing also depends on their potential to allow for high charge carrier lifetimes. Therefore it is essential that the used compositions are free of contaminants that might form recombination centers in the crystalline silicon bulk during high-temperature diffusion processes.

The passivation of partially ink composition protected Si wafers by PECVD-deposited $SiN_x$ after diffusion, is a sensitive method to detect any effect of the compositions on the bulk carrier lifetime. Comparison of the bulk carrier lifetime in covered and non-covered areas would reveal potential contaminations, particularly by highly mobile cations that would diffuse into the silicon bulk material and form recombination centers there. The absence of such cationic (metallic) contaminations is one of the most important prerequisites for high-temperature processes.

Figure 6:
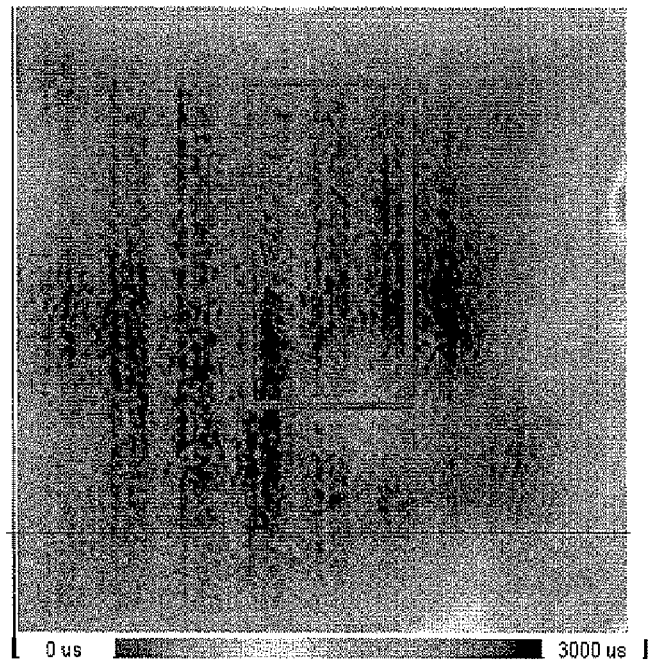
FIG. 6 depicts shows the spatially resolved carrier lifetime of a 200 Ω cm p-type Si wafer after protection by a layer resulting from the ink composition, phosphorus diffusion, removal of the emitter, and surface passivation by $SiN_x$.
Figure 7:
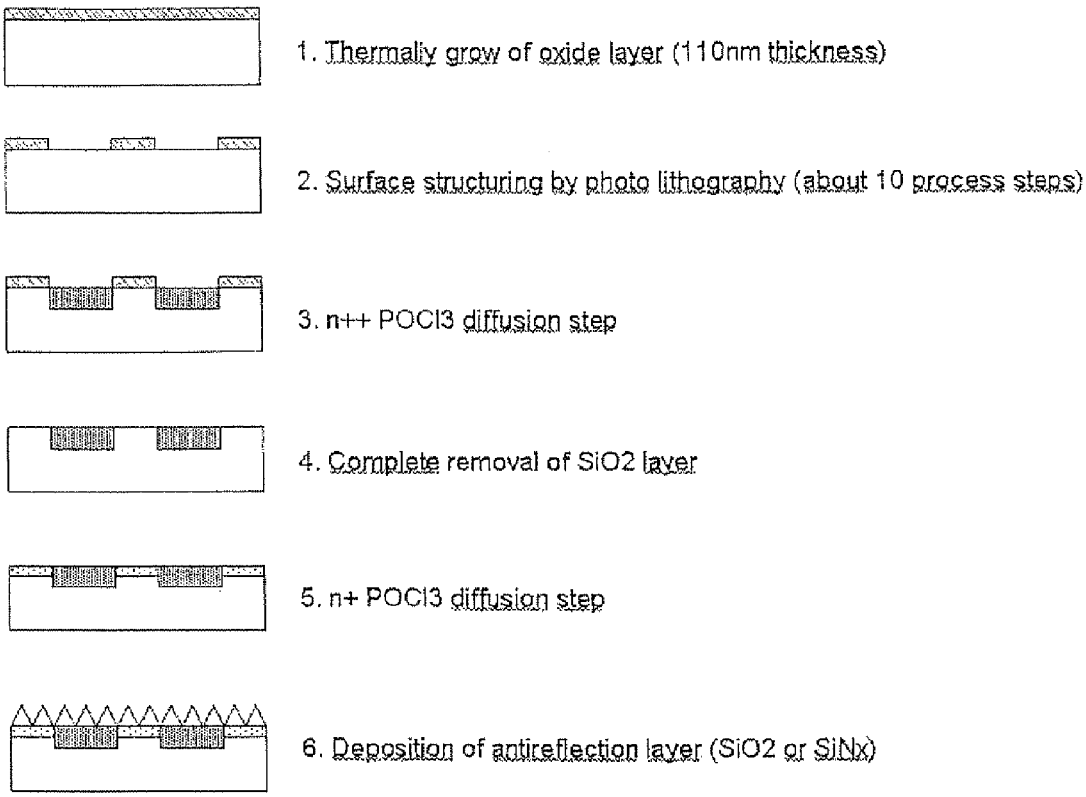
FIG. 7 depicts a common manufacturing process for selective emitters.
Figure 8:
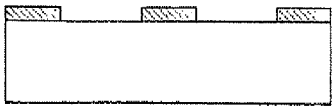
FIG. 8 depicts a manufacturing process for selective emitters according to the present invention.
Figure 8:
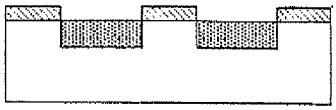
Figure 8:
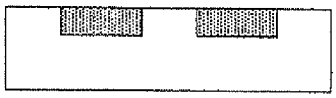
Figure 8:
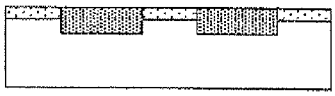
Figure 8:
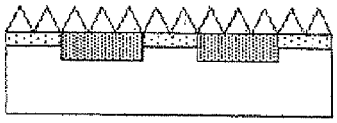

FIG. 6 shows the spatially resolved carrier lifetime of a 200 Ω cm p-type Si wafer after protection by a layer resulting from the ink composition, phosphorus diffusion, removal of the emitter, and surface passivation by $SiN_x$. The red rectangle shows the area that was protected by a layer resulting from the ink composition. No effect of the ink composition on the carrier lifetime is discernible. The mean effective carrier lifetime is $\tau_{eff}$=(2700±100) μs in both, covered and non-covered areas.

The bulk carrier diffusion length $L_{bulk}$=(4.5±1) mm is calculated in accord with the formula:

$$\frac{1}{\tau_{eff}} = \frac{D}{L_{bulk}^2} + \frac{2S}{W}, \tag{1}$$

where D=34.3 $cm^2/s$ is the diffusion constant, W=300 μm is the thickness of wafer, and S=(3±1) cm/s is the recombination velocity of the SiNx-passivated surfaces, as deduced from lifetime measurements on reference wafers without diffusion and without protection with layers produced from the compositions described here.

The obtained value of the bulk carrier diffusion length is very close to the intrinsic value of 6.7 mm as calculated from the parameterization by Kerr and Cuevas. It is therefore concluded that the applied composition is free of contaminants that could affect the bulk quality of solar cell in high-temperature diffusion processes.

FIG. 6: shows a spatially resolved measurement of the effective charge carrier lifetime of a 200 Ω cm p-type Si wafer after protection by a layer resulting from an exemplary ink composition, phosphorus diffusion, removal of the emitter, and surface passivation by $SiN_x$. The (red) rectangle shows the area that was protected by a layer resulting from an exemplary ink composition. No effect of the ink composition on the bulk carrier lifetime is discernible.

Throughout the present description all compositions according to the invention named either as precursor compositions or ink compositions or simply compositions are the same and suitable for the generation of patterned or structured $SiO_2$-layers or of $SiO_2$-lines.

The present description enables the person skilled in the art to apply the invention comprehensively. In the case of any lack of clarity, it goes without saying that the cited publications and patent literature should be employed. Accordingly, these documents are regarded as part of the disclosure content of the present description.

For better understanding and in order to illustrate the invention, examples are given below which are within the scope of protection of the present invention. These examples also serve to illustrate possible variants. Owing to the general validity of the inventive principle described, however, the examples are not suitable for reducing the scope of protection of the present application to these alone.

It goes without saying to the person skilled in the art that, both in the examples given and also in the remainder of the description, the component amounts present in the ink compositions always only add up to 100% by weight, based on the composition as a whole, and cannot go beyond this, even if higher values could arise from the percentage ranges indicated.

The temperatures given in the examples and description and in the claims are always quoted in ° C.

EXAMPLES

Example 1

Preparation Process for Inkjet Printable Dope Barrier 45 g Tetraethyl orthosilicate are stirred into a mixture of 10 g DI water, 95 g ethanol, 80 g Ethylacetate and 20 g Acetic acid. The mixture is cooked under reflux for 24 hours.

This reaction mix containing approximately 10% of the $SiO_2$ film precursor compound 1 (R=Et) in a mixture of ethanol/ethyl acetate and acetic acid is placed in a rotary evaporator flask and an equal volume of diethylene glycol monoethyl ether to the existing ethanol/ethyl acetate and acetic acid mixture is added. This volume of solvent is then evaporated under reduced pressure on a rotary evaporator with slight heating of the flask (up to 50° C.). The resulting ink is filtered to 0.45 micron. The viscosity was found to be 7.05 cp@25° C. and the surface tension of 31.10 Dyne $cm^{-1}$. The ink was then evaluated for jetting performance using a FujiFilm Dimatix DMP printer with a 10 pl head.

Optimum jetting conditions were identified as Drive voltage 11 V, Firing frequency 5 KHz, Pulse width 3.7 μs, Head temperature 23° C., Meniscus set point 5.0. FIG. 1 shows an image of the high quality of the jetting obtained Lines with a gap are then inkjet printed on an un-doped Si wafer using a FujiFilm Dimatix DMP printer fitted with a 10 pl volume head. The solvent is dried at 150° C. and the sample is then returned to Merck SL for baking at 800° C. and testing as a p-dope resist against phosphorus oxychloride.

Example 2

Preparation Process for Inkjet Printable Dope Barrier 90 g Tetraethyl orthosilicate are stirred into a mixture of 19 g DI water, 200 g ethanol, 161 g ethylene glycol monobutylether and 40 g Acetic acid. The mixture is cooked under reflux for 12 hours. The chilled solution is filtered by 0.2 micron membrane in order to remove all particles. The solution is qualified for inkjet now.

Example 3

Preparation Process for Inkjet Printable Dope Barrier 90 g Tetraethyl ortho silicate are stirred into a mixture of 26 g DI water, 190 g ethanol, 161 g ethylacetate and 35 g acetic acid. The mixture is cooked under reflux for 12 hours. This mixture is stirred into 170 g DMSO and filled into a round bottomed flask. Ethylacetate is removed by a rotating evaporator. The chilled solution is filtered by 0.2 micron membrane to remove all particles. The solution is qualified for inkjet now.

Example 4

Tetramethyl orthosilicate (TMOS) sol is prepared by sonication a mixture of the precursor TMOS (1.5 ml), water (0.4 ml) and 0.04 M HCl (0.022 ml) for about twenty minutes. Two samples of TMOS sol-gel are prepared, one by mixing a portion of the TMOS sol in a 1:1 volumetric ratio with the first stock solution, the other by mixing a portion of the TMOS sol in a 1:1 volumetric ratio with the second stock solution. This mixture is stirred into DMSO to achieve a $SiO_2$ concentration about 5%. The solution is filtered by 2 micron membrane to remove all particles.

The invention claimed is:

1. A process for the manufacturing of a semiconductor device, comprising generating $SiO_2$-layers or $SiO_2$-lines on a substrate surface by applying a precursor composition comprising (A) a $SiO_2$ precursor or precursor mixture of the general formula (I)

(I)

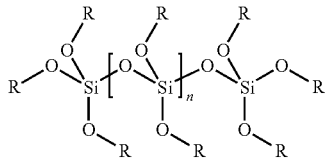

wherein independently from each other

R A, AOA, Ar, AAr, AArA, AOAr, AOArA, AArOA, wherein A is linear or branched $C_1$-$C_{18}$-alkyl, or substituted or unsubstituted cyclic $C_3$-$C_8$ alkyl; Ar is a substituted or unsubstituted aromatic group having 6-18 carbon atoms, and, $n$=1–100 and wherein R may build a further direct bond to Si or to neighboring groups R and (B) a high boiling solvent or homogeneous solvent mixture with a boiling temperature >100° C. and <400° C., which is at least an alcohol or a homogeneous mixture of alcohols or a homogeneous mixture of at least one alcohol and at least one organic co-solvent or a homogeneous mixture of co-solvents and at least one alcohol, wherein said precursor composition is ink jet printable.

2. A process according to claim 1, wherein patterned or structured $SiO_2$-layers or $SiO_2$-lines are generated with high resolution by use of $SiO_2$ precursor compositions, which are inkjet printed.

3. A process according to claim 2, wherein patterned or structured $SiO_2$-layers or $SiO_2$-lines are generated with a resolution of from 1 to 80 μm.

4. A process according to claim 1, wherein patterned or structured $SiO_2$-layers or $SiO_2$-lines are generated by inkjet printing an $SiO_2$ precursor composition, comprising at least one high boiling alcohol as solvent, with high resolution on a substrate surface, drying and treating at high temperature for converting the precursor into solid $SiO_2$.

5. A process according to claim 4, wherein patterned or structured $SiO_2$-layers or $SiO_2$-lines are generated with a resolution of from 1 to 80 μm.

6. A process according to claim 1, wherein the $SiO_2$ precursor composition is inkjet printed at temperatures from room temperature up to 300° C. and dried at temperatures of 80-400° C.

7. A process according to claim 6, wherein the $SiO_2$ precursor compositions are inkjet printed at temperatures in the range from room temperature up to 150° C. and dried at temperatures in the range of 100-200° C.

8. A process according to claim 7, wherein the $SiO_2$ precursor compositions are inkjet printed at temperatures in the range from room temperature up to 70° C. and dried at temperatures in the range of 100-200° C.

9. A process according to claim 1, wherein after printing the $SiO_2$ precursor composition is dried at a temperature higher than 500° C. and less than 1000° C. and converted to a barrier film consisting of $SiO_2$.

10. A process according to claim 1, wherein the $SiO_2$ precursor composition is dried at a temperature higher than 650° C. and less than 900° C. and converted to a barrier film consisting of $SiO_2$.

11. A process according to claim 1, wherein the temperature for drying and subsequently converting is elevated by slow degrees in order to save the treated wafers but also in order to evaporate the solvents smoothly.

12. A semiconductor device fabricated according to the process of claim 1.

13. A $SiO_2$ precursor composition, comprising (A) a $SiO_2$ precursor or precursor mixture of the general formula (I)

(I)

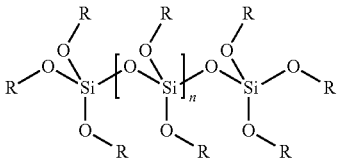

wherein independently from each other

R A, AOA, Ar, AAr, AArA, AOAr, AOArA, AArOA, wherein A is linear or branched $C_1$-$C_{18}$-alkyl, or substituted or unsubstituted cyclic $C_3$-$C_8$ alkyl; Ar is a substituted or unsubstituted aromatic group having 6-18 carbon atoms, and, $n$=1–100 and wherein R may build a further direct bond to neighbouring Groups R and (B) a high boiling solvent or homogeneous solvent mixture with a boiling temperature >100° C. and <400° C., which is at least an alcohol or a homogeneous mixture of alcohols or a homogeneous mixture of at least one alcohol and at least one organic co-solvent or a homogeneous mixture of co-solvents and at least one alcohol.

14. A $SiO_2$ precursor composition according to claim 13, comprising a $SiO_2$ precursor or precursor mixture of the general formula (I), wherein R is methyl, ethyl, i- or n-propyl.

15. A $SiO_2$ precursor composition according to claim 14, wherein R is ethyl.

16. A $SiO_2$ precursor composition according to claim 13, comprising at least an alcohol selected from the group tetraethylene glycol, glycerol, dipropylene glycol, 4-methoxybenzyl alcohol, tripropylene glycol, dipropylene glycol butyl ether, 2-phenoxyethanol, diethanolamine, triethylene glycol, ethylene glycol, 2-undecanol, ethylene glycol 2-ethylhexyl ether, diethylene glycol propyl ether, ethylene glycol hexyl ether, diethylene glycol, 1-decanol, a-terpineol, lactic acid, hexylene glycol, propylene glycol, 1-nonanol, dipropylene glycol methyl ether, diethylene glycol butyl ether, 1,3-butanediol, benzyl alcohol, 1-octanol, 2-methyl-2-heptanol, 2-octanol, 2,2-dimethyl-1-pentanol, 1-heptanol, ethylene glycol butyl ether, 4-heptanol, 3-heptanol, diethylene glycol ethyl ether, tetrahydrofurfuryl alcohol, propylene glycol butyl ether, furfuryl alcohol, diacetone alcohol, 2-heptanol, ethanolamine, 5-methyl-2-hexanol, diethylene glycol methyl ether, ethylene glycol butyl ether, 1-hexanol, cyclohexanol, 3-methylcyclohexanol, 2,2-dimethyl-1-butanol, 4-methyl-1-pentanol, ethylene glycol propyl ether, ethyl lactate, 2-hexanol, 2-methyl-1-pentanol, 2-ethyl-1-butanol, 3-hexanol, 3-methyl-2-pentanol 1-pentanol, cyclopentanol, 4-methyl-2-pentanol, 2-methyl-3-pentanol, 3-methyl-1-butanol, ethylene glycol ethyl ether, 3,3-dimethyl-1-butanol, 2-methyl-1-butanol, 2-pentanol, ethylene glycol methyl ether, 3-pentanol, propylene glycol methyl ether, 1-butanol, 2-methyl-1-propanol.

17. A $SiO_2$ precursor composition according to claim 13, comprising at least an alcohol selected from the group methyl alcohol, ethyl alcohol, n-propyl alcohol, lisopropyl alcohol, n-butyl alcohol, 2-ethyl-1 butanol, sec-butyl alcohol, tert-butyl alcohol, isobutyl alcohol, iso-amyl alcohol, n-amyl alcohol, t-amyl alcohol, n-hexyl alcohol, heptanol, octanaol, allyl alcohol, crotyl alcohol, ethylene glycol, propylene glycol, trimethylene glycol, glycerol, methyl isobutyl carbinol, 2-ethyl-1-hexanol, diacetone alcohol, nonyl alcohol, decyl alcohol, cetyl alcohol, cyclohexanol, furfuryl alcohol, tetrahydrofurfuryl alcohol, benzyl alcohol and, phenyl ethyl alcohol.

18. A $SiO_2$ precursor composition according to claim 13, comprising at least one organic co-solvent that is an aromatic or heteroaromatic hydrocarbon, or which is a linear or branched aliphatic hydrocarbon or a mixture thereof.

19. A $SiO_2$ precursor composition according to claim 18, wherein said aromatic or heteroaromatic hydrocarbon is toluene, xylene, a xylene isomer, tetralin, indan, a mono, di, tri, tetra, penta or hexa alkyl benzene, naphthalene, alkyl naphthalene, alkylthiazoles or an alkylthiophene.

20. A $SiO_2$ precursor composition according to claim 18, wherein said linear or branched alkane is n-octane, a cycloalkane, a methylcyclohexane, decalin or a mixture thereof.

21. A $SiO_2$ precursor composition according to claim 13, comprising at least one organic co-solvent that is toluene, xylene (all isomers), tetralin, indan, benzene, naphthalene n-octane methylcyclohexane or decalin.

22. A $SiO_2$ precursor composition according to claim 13, wherein said solvent is an aromatic and aliphatic fluoro solvent, an ether, an ester, a lactone, a ketone, a amide or a sulphone or a solvent mixture thereof.

23. A $SiO_2$ precursor composition according to claim 22, wherein said solvent is FC43, FC70, methyl nonafluorobutyl ether, 3-ethoxy-1,1,1,2,3,4,4,5,5,6,6,6-dodecafluoro-2-trifluoromethyl-hexane, perfluorodecane, ethylene glycol diethyl ether, amyl acetate gamma-butyrolactone, NMP, DMF, DMSO, or a mixture thereof.

24. A $SiO_2$ precursor composition according to claim 13, comprising the precursor in a concentration in the range of >0.1% to <90% by weight, based on the composition as a whole.

25. A $SiO_2$ precursor composition according to claim 24, comprising the precursor in a concentration in the range of >0.5% to <50% by weight, based on the composition as a whole.

26. A $SiO_2$ precursor composition according to claim 24, comprising the precursor in a concentration in the range of >1% to <20% by weight, based on the composition as a whole.

27. A $SiO_2$ precursor composition according to claim 13, comprising the high boiling solvent or homogeneous solvent mixture in an amount of >10% up to <99, 9% by weight, based on the composition as a whole, with the proviso that about 90% by weight of the comprising carrier solvent has a boiling point higher than 100° C. and less than 400° C. and that at least 5% by weight of the solvent mixture is an high boiling alcohol.

28. A precursor composition according to claim 27 comprising >50% up to <99.5% by weight of the high boiling solvent or homogeneous solvent mixture, based on the composition as a whole.

29. A precursor composition according to claim 27 comprising >80% up to <99% by weight of the high boiling solvent or homogeneous solvent mixture, based on the composition as a whole.

30. A $SiO_2$ precursor composition according to claim 13, having a viscosity in the range >2 and <20 cps at printing temperature.

31. A $SiO_2$ precursor composition according to claim 13, having a surface tension in a range between >20 dyne/cm and <60 dyne/cm.

32. A $SiO_2$ precursor composition according to claim 13, wherein the composition is inkjet printable.

33. A method comprising using a $SiO_2$ precursor composition according to claim 13 for the generation of patterned or structured $SiO_2$-layers or of $SiO_2$-lines during the manufacturing process of semiconductor devices, comprising generating said layers or lines by applying a SiO2 precursor according to claim 8 to a substrate.

34. A method comprising using a $SiO_2$ precursor composition according to claim 13 for micro-stamping/soft lithography, flexo or gravure process steps comprising generating said layers or lines by applying a SiO2 precursor according to claim 8 to a substrate.

35. A method to prevent boron or phosphorus diffusion on a silicon substrate comprising applying a SiO2 precursor according to claim 13 to a substrate to create a $SiO_2$ diffusion barrier on said silicon substate.

* * * * *

UNITED STATES PATENT AND TRADEMARK OFFICE

CERTIFICATE OF CORRECTION

PATENT NO. : 8,318,613 B2
APPLICATION NO. : 12/934365
DATED : November 27, 2012
INVENTOR(S) : Werner Stockum et al.

It is certified that error appears in the above-identified patent and that said Letters Patent is hereby corrected as shown below:

Column 14, line 39 reads: "R A, AOA, Ar, AAr, AArA, AOAr, AOArA, AArOA," should read:

-- R A, AOA, Ar, AAr, AArA, AOAr, AOArA, AAROA, --.

Column 15, line 45 reads: "R A, AOA, Ar, AAr, AArA, AOAr, AOArA, AArOA," should read:

-- R A, AOA, Ar, AAr, AArA, AOAr, AOArA, AAROA, --.

Signed and Sealed this
Nineteenth Day of March, 2013

Teresa Stanek Rea
*Acting Director of the United States Patent and Trademark Office*